US010012140B2

(12) United States Patent
Naruoka

(10) Patent No.: US 10,012,140 B2
(45) Date of Patent: Jul. 3, 2018

(54) ENGINE SUPERCHARGER

(71) Applicant: KAWASAKI JUKOGYO KABUSHIKI KAISHA, Kobe-shi, Hyogo (JP)

(72) Inventor: Shohei Naruoka, Kakogawa (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 0 days.

(21) Appl. No.: 15/087,931

(22) Filed: Mar. 31, 2016

(65) Prior Publication Data

US 2016/0215688 A1 Jul. 28, 2016

Related U.S. Application Data

(63) Continuation of application No. PCT/JP2014/080311, filed on Nov. 17, 2014.

(30) Foreign Application Priority Data

Nov. 18, 2013 (WO) ..... PCT/JP2013/081037
Nov. 18, 2013 (WO) ..... PCT/JP2013/081039
Oct. 31, 2014 (JP) ..... 2014-222865

(51) Int. Cl.
*F02B 39/14* (2006.01)
*F02B 33/40* (2006.01)
(Continued)

(52) U.S. Cl.
CPC ..... *F02B 39/14* (2013.01); *F02B 33/40* (2013.01); *F02B 39/04* (2013.01); *F02B 61/02* (2013.01);
(Continued)

(58) Field of Classification Search
CPC ..... F02B 33/40; F02B 39/04; F02B 39/14; F02B 61/02; F04D 25/028; F04D 29/063;
(Continued)

(56) References Cited

U.S. PATENT DOCUMENTS 4,900,343 A * 2/1990 Minami ..... F02B 33/44 55/318
7,040,874 B1 5/2006 Martin et al.
(Continued)

FOREIGN PATENT DOCUMENTS

DE 102007062223 6/2009
DE 102009021516 12/2009
(Continued)

OTHER PUBLICATIONS

"Supercharger," Dictionary.com Unabridged, Retrieved Oct. 25, 2017 from Dictionary.com website, http://www.dictionary.com/browse/supercharger.*
(Continued)

*Primary Examiner* — Audrey K Bradley

(57) ABSTRACT

A supercharger includes: an impeller that pressurizes intake air for a combustion engine; a supercharger rotation shaft to which the impeller is fixed; and a supercharger case rotatably supporting the supercharger rotation shaft. A supercharger lubricating fluid passage that guides a lubricating fluid to a bearing housing is formed inside the supercharger case, and an oil filter that removes foreign matter from the lubricating fluid is disposed in the supercharger lubricating fluid passage. The oil filter is detachably mounted on the supercharger case by an operation from the outside of the supercharger.

13 Claims, 5 Drawing Sheets

(51) Int. Cl.

| | |
|---|---|
| ***F04D 29/06*** | (2006.01) |
| ***F04D 29/40*** | (2006.01) |
| ***F04D 29/42*** | (2006.01) |
| ***F02B 39/04*** | (2006.01) |
| ***F04D 29/063*** | (2006.01) |
| ***F04D 29/62*** | (2006.01) |
| ***F02B 61/02*** | (2006.01) |
| ***F04D 25/02*** | (2006.01) |
| *F01M 11/02* | (2006.01) |

(52) U.S. Cl.
CPC ..... *F04D 25/028* (2013.01); *F04D 29/063* (2013.01); *F04D 29/4206* (2013.01); *F04D 29/624* (2013.01); *F01M 2011/021* (2013.01)

(58) Field of Classification Search
CPC ..... F04D 29/4206; F04D 29/624; F01M 2011/021
See application file for complete search history.

(56) References Cited

U.S. PATENT DOCUMENTS

| | | | | |
|---|---|---|---|---|
| 8,051,660 | B2 | 11/2011 | Weisz | |
| 8,234,867 | B2 | 8/2012 | Palazzolo et al. | |
| 8,707,931 | B2 | 4/2014 | Arima et al. | |
| 9,127,591 | B2 | 9/2015 | Arima et al. | |
| 2002/0124566 | A1* | 9/2002 | Kapich | F01D 1/14 60/608 |
| 2004/0109773 | A1* | 6/2004 | Mashimo | F02M 37/08 417/423.3 |
| 2008/0072867 | A1 | 3/2008 | Ueshima et al. | |
| 2009/0158732 | A1* | 6/2009 | Weisz | F02B 37/00 60/602 |
| 2009/0320471 | A1 | 12/2009 | Palazzolo et al. | |
| 2010/0059317 | A1* | 3/2010 | Palazzolo | F01D 25/18 184/6.16 |
| 2010/0310366 | A1* | 12/2010 | Eguchi | F01D 25/168 415/229 |
| 2011/0131984 | A1* | 6/2011 | Lofgren | F02B 37/105 60/607 |
| 2012/0186565 | A1 | 7/2012 | Arima et al. | |
| 2012/0192839 | A1 | 8/2012 | Arima et al. | |

FOREIGN PATENT DOCUMENTS

| | | | | |
|---|---|---|---|---|
| JP | 44-017880 | | 8/1969 | |
| JP | 58-09033UA | | 6/1983 | |
| JP | 60-124514 | | 8/1985 | |
| JP | 02-070920 | | 3/1990 | |
| JP | 02-163539 | | 6/1990 | |
| JP | 06-212989 | | 8/1994 | |
| JP | 06212989 | A * | 8/1994 | |
| JP | 2000-034931 | | 2/2000 | |
| JP | 2007-023901 | | 2/2007 | |
| JP | 2013/224676 | | 10/2013 | |
| WO | WO2011/046098 | | 4/2011 | |
| WO | WO 2013122857 | A1 * | 8/2013 | F01D 25/16 |

OTHER PUBLICATIONS

English Translation of the International Preliminary Report on Patentability and Written Opinion of the International Searching Authority dated Jun. 2, 2016 for International PCT Patent Application No. PCT/JP2014/080311, filed Nov. 17, 2014 (7 pages).
International Search Report (dated Feb. 17, 2015) for International Patent Application PCT/JP2014/080311, filed Nov. 17, 2014 (4 pages).
Extended and Supplementary Search Report Issued Jun. 28, 2017 for Corresponding European Patent Application No. 14861748.3 (6 pages).
First Office Action Issued Sep. 29, 2017 for Corresponding Chinese Patent Application No. 201480061655.8 with English language translation of the Search Report attached to the Office Action (8 pages).

* cited by examiner

ENGINE SUPERCHARGER

CROSS REFERENCE TO THE RELATED APPLICATION

This application is a continuation application, under 35 U.S.C § 111(a) of international patent application No. PCT/JP2014/080311, filed Nov. 17, 2014, which claims priority to international patent applications No. PCT/JP2013/081037 and No. PCT/JP2013/081039, filed Nov. 18, 2013, and Japanese patent application No. 2014-222865, filed Oct. 31, 2014, the entire disclosure of which is herein incorporated by reference as a part of this application.

BACKGROUND OF THE INVENTION

Field of the Invention

The present invention relates to a supercharger which pressurizes intake air for a combustion engine.

Description of Related Art

For example, a combustion engine for a motorcycle, which is equipped with a supercharger in order to increase output of the combustion engine has been known (e.g., Patent Document 1).

RELATED DOCUMENT

Patent Document

[Patent Document 1] WO 2011/046098

When a lubricating fluid dedicated to the supercharger is to be supplied to the supercharger for the combustion engine, the structure may be complicated. When a lubricating fluid for the combustion engine is supplied to the supercharger, foreign matter which has got mixed into the lubricating fluid during lubrication of the combustion engine may be contained in the lubricating fluid to be supplied to the supercharger.

SUMMARY OF THE INVENTION

An object of the present invention is to provide a supercharger for a combustion engine, which allows a lubricating fluid for the combustion engine to be suitably used for lubrication of the supercharger.

In order to achieve the above object, a supercharger for a combustion engine according to the present invention includes: an impeller configured to pressurize intake air for the combustion engine; a supercharger rotation shaft to which the impeller is fixed; a supercharger case covering the supercharger rotation shaft; a supercharger lubricating fluid passage formed inside the supercharger case, and configured to guide a lubricating fluid for the combustion engine to a portion-to-be-lubricated; and a filter disposed in the supercharger lubricating fluid passage, and configured to remove foreign matter from the lubricating fluid. The filter is detachably mounted on the supercharger case.

According to this configuration, since the filter is disposed in the supercharger lubricating fluid passage, even when the lubricating fluid for the combustion engine is used for lubrication of the supercharger, foreign matter contained in the lubricating fluid during lubrication of the combustion engine can be removed by the filter. Accordingly, the lubricating fluid for the combustion engine can be suitably used for lubrication of the supercharger. In addition, since the filter is detachably mounted on the supercharger case, even when the supercharger lubricating fluid passage is formed inside the supercharger case, the oil filter can be easily replaced or cleaned.

In the present invention, preferably, the filter includes: a filter portion that removes the foreign matter from the lubricating fluid; a mounting portion having an external thread to be screwed into an internal thread formed in the supercharger case; and an operation portion exposed to the outside of the supercharger case, with which a tool for attachment/detachment is engaged. According to this configuration, the oil filter can be easily replaced by operating the operation portion by using the tool. In this case, the mounting portion may also serve as a sealing portion that seals the supercharger lubricating fluid passage. When the mounting portion concurrently serves as the sealing portion, the number of components can be reduced.

In the case where the oil filter has the mounting portion, preferably, the supercharger lubricating fluid passage includes a first passage that extends in parallel to a fastening direction of the mounting portion, and a second passage that extends in a direction intersecting the fastening direction and is connected to the first passage, and the filter portion is disposed at a connecting portion between the first passage and the second passage. According to this configuration, the filter can be formed by using a plug hole in machining.

In the case where the supercharger lubricating fluid passage has the first passage and the second passage, preferably, the first passage extends in a radial direction from a bearing portion of the supercharger rotation shaft in the supercharger case, and has a radially outer end portion being opened, and the filter is mounted to the opened end portion of the first passage. According to this configuration, the filter can be disposed in the vicinity of a bearing portion which is a portion-to-be-lubricated.

In the present invention, preferably, where the supercharger case is composed of two case halves being connected to each other by means of a bolt, and a part of the supercharger lubricating fluid passage extends in an axial direction of the bolt across the two case halves, a flow rate adjuster that constitutes a part of the supercharger lubricating fluid passage is provided in the supercharger case, in which case the flow rate adjuster can be attached to and detached from the supercharger case by separating the two case halves from each other by loosening the bolt. According to this configuration, even when the amount of the lubricating fluid supplied from the combustion engine is larger than the amount of the lubricating fluid required for the supercharger, the flow rate of the lubricating fluid can be adjusted by selecting the flow rate adjuster.

In the present invention, preferably, the supercharger further includes: a planetary gear device configured to change a speed of power, and output the power to the supercharger rotation shaft; an input shaft configured to input the power to the planetary gear device; and a positioning member. Preferably, an internal gear engaged with a planetary gear of the planetary gear device is connected with an input gear of the input shaft, with movement of the input shaft in an axial direction being restricted by the positioning member. According to this configuration, movement of the input shaft in the axial direction can be restricted by the positioning member. As a result, the relative position between the internal gear and the input gear in the axial direction can be appropriately restricted.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Hereinafter, a preferred embodiment of the present invention will be described with reference to the drawings. The terms "left side" and "right side" in this specification are the left side and the right side as viewed from a driver on a vehicle.

Figure 1:
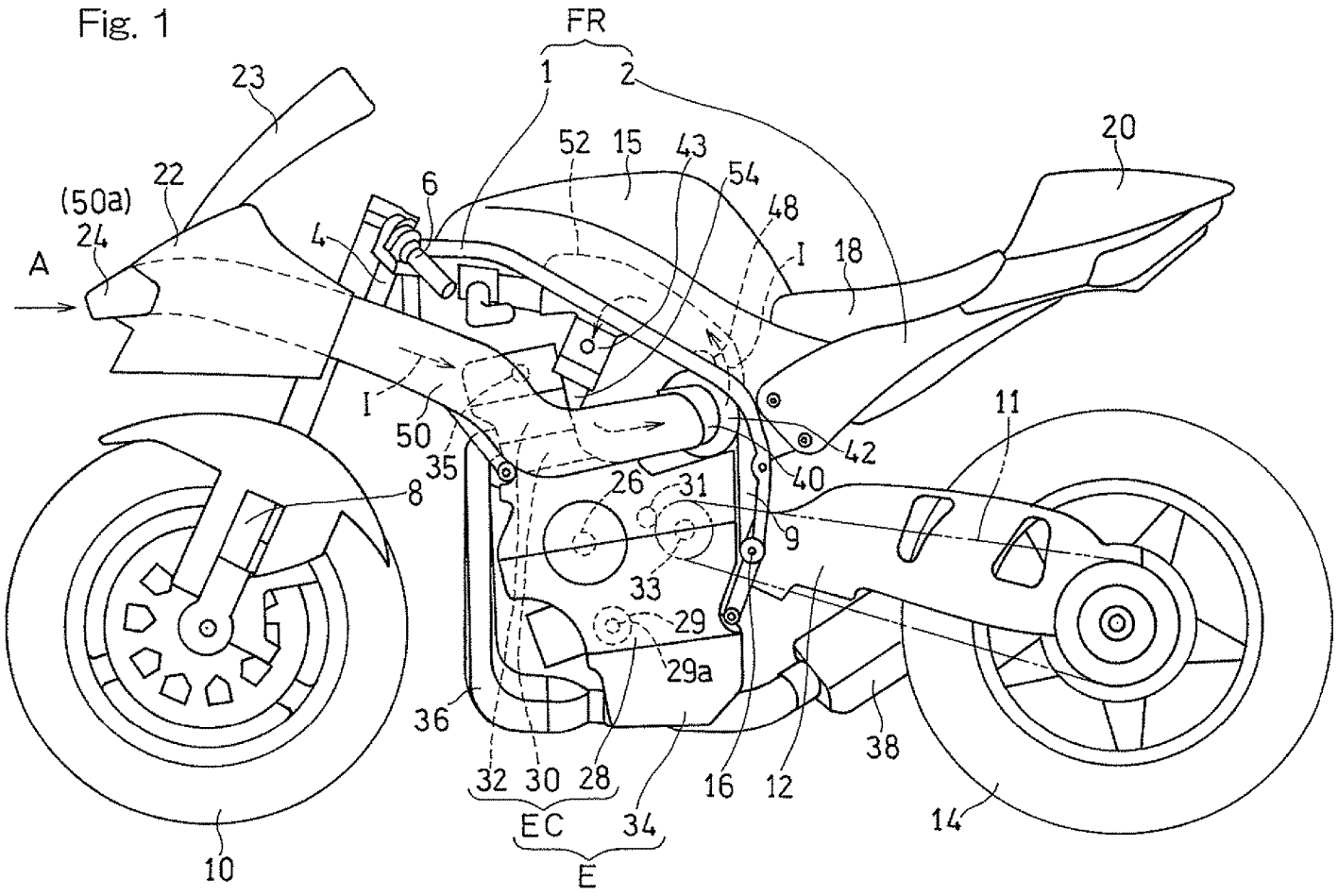
FIG. 1 is a side view showing a motorcycle equipped with a supercharger for a combustion engine, according to a first preferred embodiment of the present invention.

FIG. 1 is a side view of a motorcycle equipped with a supercharger for a combustion engine, according to a first preferred embodiment of the present invention. A motorcycle frame structure FR of the motorcycle includes a main frame 1 which forms a front half of the motorcycle frame structure FR, and a rear frame 2 which forms a rear half of the motorcycle frame structure FR. A head pipe 4 is formed at a front end of the main frame 1, and a front fork 8 is pivotally supported by the head pipe 4 through a steering shaft (not shown). A front wheel 10 is mounted on a lower end portion of the front fork 8. A steering handle 6 is fixed to an upper end portion of the front fork 8.

Meanwhile, a swingarm bracket 9 is provided at a rear end portion of the main frame 1 which is a lower intermediate portion of the motorcycle frame structure FR. A swingarm 12 is supported for swing movement in a vertical direction about a pivot shaft 16 which is mounted on the swingarm bracket 9. A rear wheel 14 is rotatably supported by a rear end portion of the swingarm 12. A combustion engine E is mounted on the lower intermediate portion of the motorcycle frame structure FR at the front side of the swingarm bracket 9. This combustion engine E drives the rear wheel 14 through a drive chain 11.

The combustion engine E includes: a crankshaft 26 having a rotary shaft extending in a left-right direction (vehicle widthwise direction); a crankcase 28 supporting the crankshaft 26; a cylinder block 30 projecting upward from an upper surface of a front portion of the crankcase 28; a cylinder head 32 above the cylinder block 30; and an oil pan 34 provided below the crankcase 28. Although in the present embodiment the combustion engine E is a four-cylinder four-cycle type combustion engine, the engine E is not limited thereto.

In the present embodiment, the crankcase 28 and the cylinder block 30 are integrally formed by molding, and a rear portion of the crankcase 28 serves as a transmission case. A transmission shaft 31 and an output shaft 33 of a combustion engine transmission are accommodated in the transmission case. A camshaft 35 that opens and closes an intake/exhaust valve (not shown) is mounted on an upper surface of the cylinder head 32. To the camshaft 35, rotation is transmitted from the crankshaft 26 through a power transmitting member (not shown) such as a chain, belt, or the like. The crankcase 28, the cylinder block 30, and the cylinder head 32 cooperate together to form a combustion engine case EC.

A lubricating fluid pump 29 is provided in the crankcase 28 of the combustion engine E. A rotational force of the crankshaft 26 is gear-transmitted to a rotary shaft 29*a* of the lubricating fluid pump 29, and the lubricating fluid pump 29 is driven by the combustion engine E. The lubricating fluid pump 29 supplies a lubricating oil to portions-to-be-lubricated of the combustion engine body, such as the crankshaft 26 and the camshaft 35, and to portions-to-be-lubricated of the transmission, such as the transmission shaft 31 and the output shaft 33, through a combustion engine lubricating fluid passage 95 (FIG. 3) formed in the combustion engine case EC. Further, the lubricating fluid pump 29 also supplies the lubricating fluid to a supercharger 42 described later.

Four exhaust pipes 36 are connected to a front surface of the cylinder head 32. The four exhaust pipes 36 are merged together at a location beneath the combustion engine E, and are connected to an exhaust muffler 38 disposed at the right side of the rear wheel 14.

A fuel tank 15 is disposed on an upper portion of the main frame 1, and a rider's seat 18 and a passenger's seat 20 are supported by the rear frame 2. In addition, a fairing 22 made of a resinous material is mounted on a front portion of the motorcycle. The fairing 22 covers the front of the head pipe 4. An air inlet 24 is formed in the fairing 22. The air inlet 24 is located at a front end of the fairing 22, and takes in intake air from the outside to the combustion engine E. A transparent window shield 23 is mounted on an upper portion of the fairing 22.

An air intake duct 50 is disposed at the left side of the motorcycle frame structure FR. The air intake duct 50 is supported by the head pipe 4 such that a front end opening 50*a* thereof faces the air inlet 24 of the fairing 22. The pressure of air introduced through the front end opening 50*a* of the air intake duct 50 is increased by the ram effect.

The supercharger 42 and an air cleaner 40 that cleans outside air are disposed rearward of the cylinder block 30 and on an upper surface of the crankcase 28 so as to be aligned in the vehicle widthwise direction. The air intake duct 50 introduces incoming wind A as intake air I from the front of the combustion engine E through left outer lateral sides of the cylinder block 30 and the cylinder head 32 into the air cleaner 40. The supercharger 42 is detachably mounted on the combustion engine E. The supercharger 42 pressurizes cleaned air from the air cleaner 40, and supplies the cleaned air to the combustion engine E.

An air intake chamber 52 is disposed between a discharge port 48 of the supercharger 42 and an air intake port 54 of the combustion engine E, and the discharge port 48 of the supercharger 42 and the air intake chamber 52 are directly connected to each other. The air intake chamber 52 stores the high-pressure intake air I supplied from the discharge port 48 of the supercharger 42. A throttle body 43 is disposed between the air intake chamber 52 and the air intake port 54. The air intake chamber 52 is disposed above the supercharger 42 and the throttle body 43. The fuel tank 15 is disposed above the air intake chamber 52 and the throttle body 43.

Figure 2:
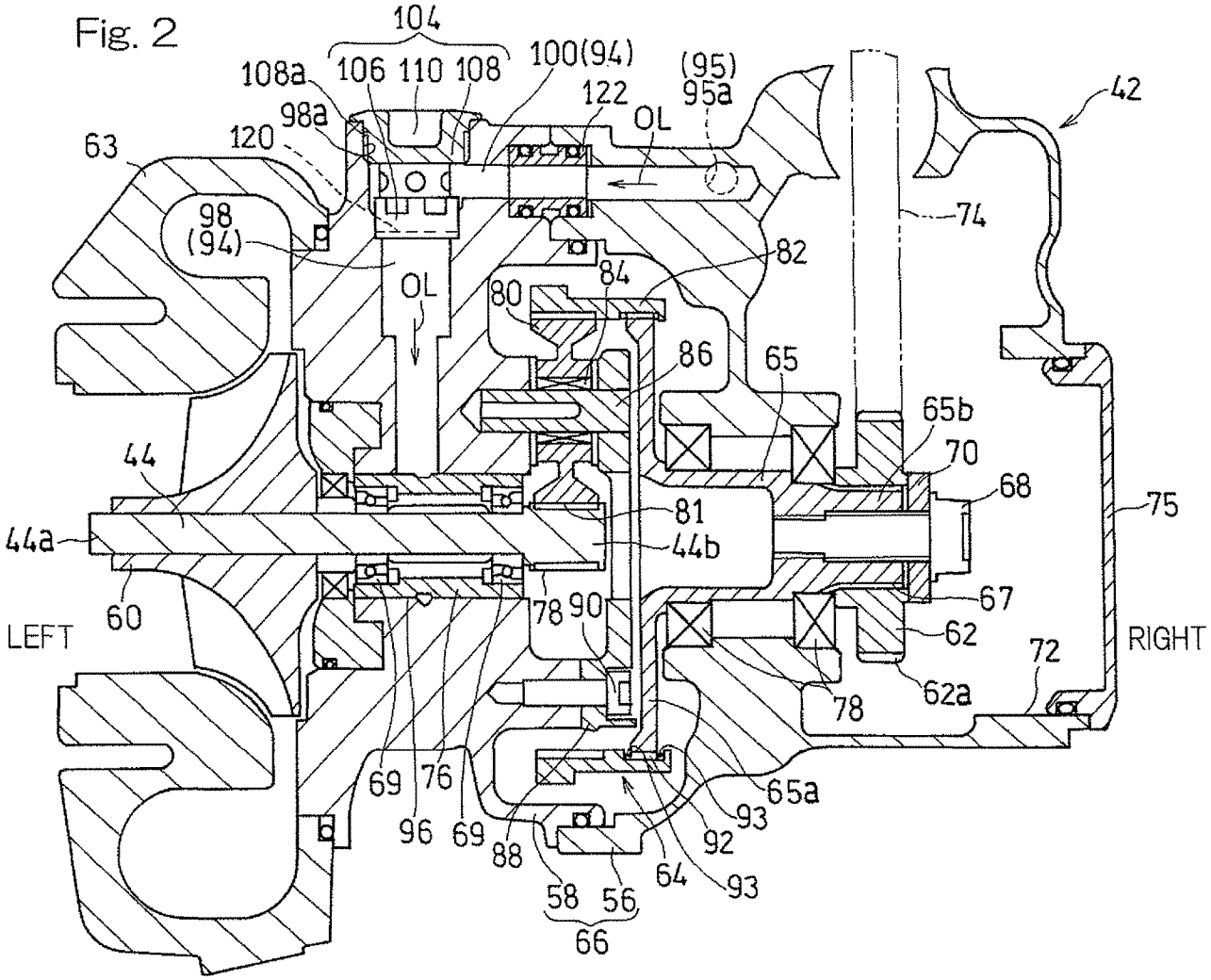
FIG. 2 is a horizontal cross-sectional view of the supercharger.

As shown in FIG. 2, the supercharger 42 is a centrifugal supercharger, and includes: a supercharger rotation shaft 44; an impeller 60 fixed to a front end portion (left end portion) 44*a* of the supercharger rotation shaft 44; an impeller housing 63 that covers the impeller 60; a supercharger case 66 that rotatably supports the supercharger rotation shaft 44; and a transmission mechanism 64 that transmits power of the combustion engine E to the supercharger rotation shaft 44. In the present embodiment, a planetary gear transmission device 64 is used as the transmission mechanism 64.

The supercharger 42 is driven by power of the combustion engine E. Specifically, the rotational force of the crankshaft 26 (FIG. 1) is transmitted to an input shaft 65, of the transmission mechanism 64, connected to the supercharger rotation shaft 44 through a chain 74. More specifically, a sprocket 62 is provided at a right end portion of the input shaft 65, and the chain 74 is entrained on a gear 62*a* of the sprocket 62.

Figure 5:
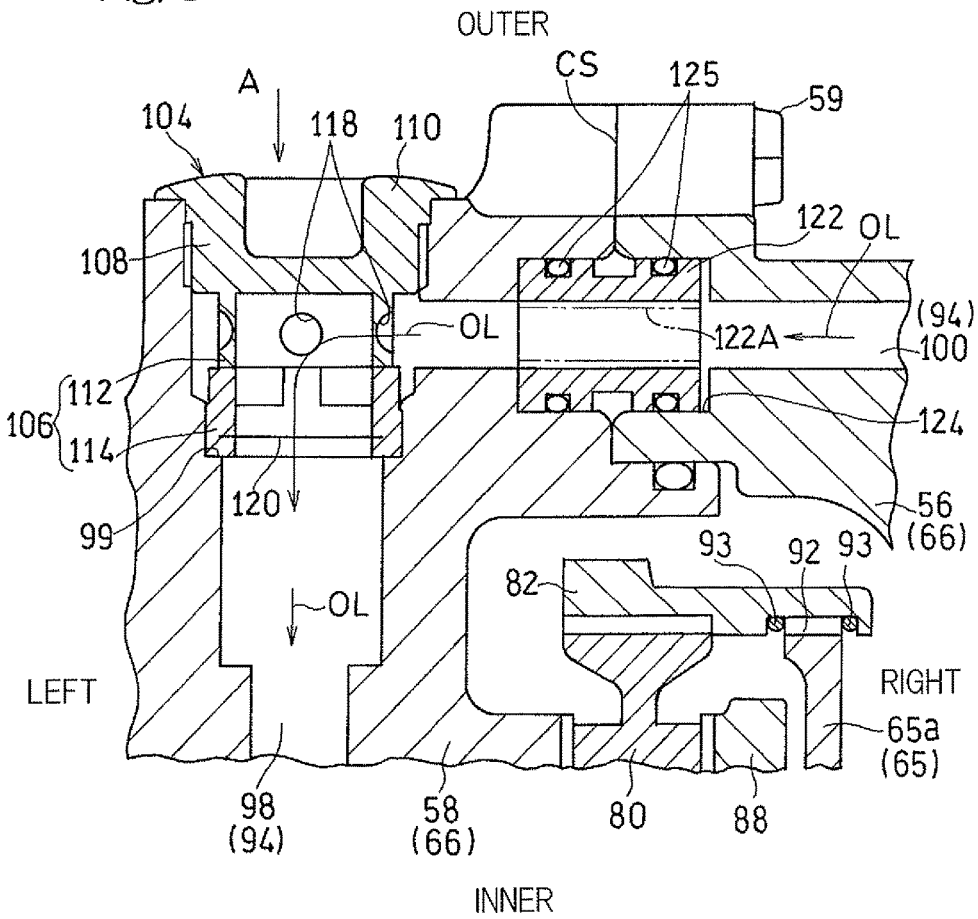
FIG. 5 is a horizontal cross-sectional view showing the supercharger in an enlarged manner.

The supercharger case 66 includes a right-side input case portion 56 that accommodates the input shaft 65 and the sprocket 62, and a left-side gear case portion 58 that accommodates the transmission mechanism 64. The input case portion 56 and the gear case portion 58 are connected to each other by means of bolts 59 (FIG. 5). That is, the input case portion 56 and the gear case portion 58 constitute two case halves 56, 58 of the supercharger case 66, respectively. Further, the impeller housing 63 is connected to the gear case portion 58 of the supercharger case 66 by means of bolts (not shown). The impeller housing 63 and the supercharger case 66 are, for example, molded articles made of an aluminum alloy.

The input shaft 65 is a hollow shaft and is rotatably supported by the input case portion 56 through a pair of bearings 78. Spline teeth 67 are formed on the outer peripheral surface of the right end portion 65*b* of the input shaft 65. The sprocket 62 is spline-fitted to the spline teeth 67, and connected to the input shaft 65.

An internal thread portion is formed on the inner peripheral surface of the right end portion 65*b* of the input shaft 65, and the sprocket 62 is mounted on the right end portion 65*b* through a washer 70 by a head portion of a bolt 68 screwed into the internal thread portion. An opening 72 facing toward the outside of the motorcycle is formed in a right end portion of the input case portion 56, and the opening 72 is closed by a cap 75.

A right end portion 44*b*, which is a base end portion, of the supercharger rotation shaft 44 is connected to a left end portion 65*a* of the input shaft 65 through the planetary gear device (transmission mechanism) 64. The left end portion 65*a* of the input shaft 65 is formed as a flange portion 65*a*. The supercharger rotation shaft 44 is rotatably supported by the gear case portion 58 through bearings 69. Two bearings 69 are aligned in the axial direction, and these two bearings 69, 69 are accommodated in a bearing housing 76. On the right end portion 44*b* of the supercharger rotation shaft 44, external teeth 78 are formed.

The planetary gear device 64 is disposed between the input shaft 65 and the supercharger rotation shaft 44, and is supported by the gear case portion 58. A plurality of planetary gears 80 are arranged in the circumferential direction and are gear-connected to the external teeth 78 on the right end portion 44*b* of the supercharger rotation shaft 44. That is, the external teeth 78 of the supercharger rotation shaft 44 function as a sun gear of the planetary gear device 64. On each planetary gear 80, a gear 81 which meshes with the sun gear (external teeth) 78 is formed. For example, three planetary gears 80 are disposed so as to be spaced apart from each other in the circumferential direction.

The planetary gears 80 are gear-connected to a large-diameter internal gear (ring gear) 82 at the outer side in the radial direction. Each planetary gear 80 is rotatably supported by a carrier shaft 86 through a bearing 84 mounted on the gear case portion 58. That is, the carrier shaft 86 forms a support shaft for the planetary gears 80. In this embodiment, a needle roller bearing is used as the bearing 84.

The carrier shaft 86 is fixed to a disk-like fixing member 88, and the fixing member 88 is fixed to the gear case portion 58 by means of a bolt 90. That is, the carrier shaft 86 is fixed, and the planetary gears 80 do not revolve around the carrier shaft 86. An input gear 92 is provided on the left end portion of the input shaft 65 and is gear-connected to the internal gear 82. The input gear 92 is an external gear obtained by forming external teeth at an outer circumference of a disk. The input gear 92 and the internal gear 82 are relatively movable in the radial direction within a range in which meshing therebetween is maintained.

In this way, the internal gear 82 is gear-connected to the input shaft 65 so as to integrally rotate in the same rotation direction as the input shaft 65, and the carrier shaft 86 is fixed, whereby the planetary gears 80 rotate in the same rotation direction as the internal gear 82. The sun gear (external gear 78) is formed on the supercharger rotation shaft 44 which is an output shaft, and rotates in a rotation direction opposite to that of the planetary gears 80.

The internal gear 82 and the input gear 92 of the input shaft 65 are connected to each other through positioning members 93, with movement of the input shaft 65 in the axial direction being restricted. The positioning members 93 are annular ring members, and are disposed on both sides of the input gear 92 in the axial direction. The positioning members 93 of the present embodiment are each formed by bending a steel wire in an annular shape.

In the supercharger case 66 shown in FIG. 2, a supercharger lubricating fluid passage 94 is formed which introduces a lubricating fluid OL supplied from the lubricating fluid pump 29 (FIG. 1) provided outside the supercharger 42, and guides the lubricating fluid OL to the bearing housing 76. The supercharger lubricating fluid passage 94 is formed simultaneously with the supercharger case 66 by molding. In the present embodiment, oil is used as the lubricating fluid OL.

Specifically, an oil layer 96 is formed between the supercharger case 66 and the bearing housing 76, and the supercharger lubricating fluid passage 94 is connected to the oil layer 96. Thus, bearing housing 76 is supported by the supercharger case 66 through the oil layer 96 so as to be movable in the radial direction of the supercharger rotation shaft 44. The oil layer 96 has a function to reduce fluctuation of the supercharger rotation shaft 44. A part of the lubricating fluid OL of the oil layer 96 is supplied to the bearings 69, which are portions-to-be-lubricated. The oil having passed through the right-side bearing 69 is supplied to the external teeth 78 and lubricates the meshing portion between the external teeth 78 and the gear 81.

The supercharger lubricating fluid passage 94 is circular in horizontal cross-section, and includes a first passage 98 that extends from the bearing housing 76 in the radial direction of the supercharger rotation shaft 44, and a second passage 100 that extends in the axial direction and is connected to a radially outer end portion of the first passage 98. The radially outer end portion of the first passage 98 is opened, and an internal thread 98*a* is formed at such an opened end portion. The second passage 100 extends across the two case halves, i.e., the input case portion 56 and the gear case portion 58.

Figure 3:
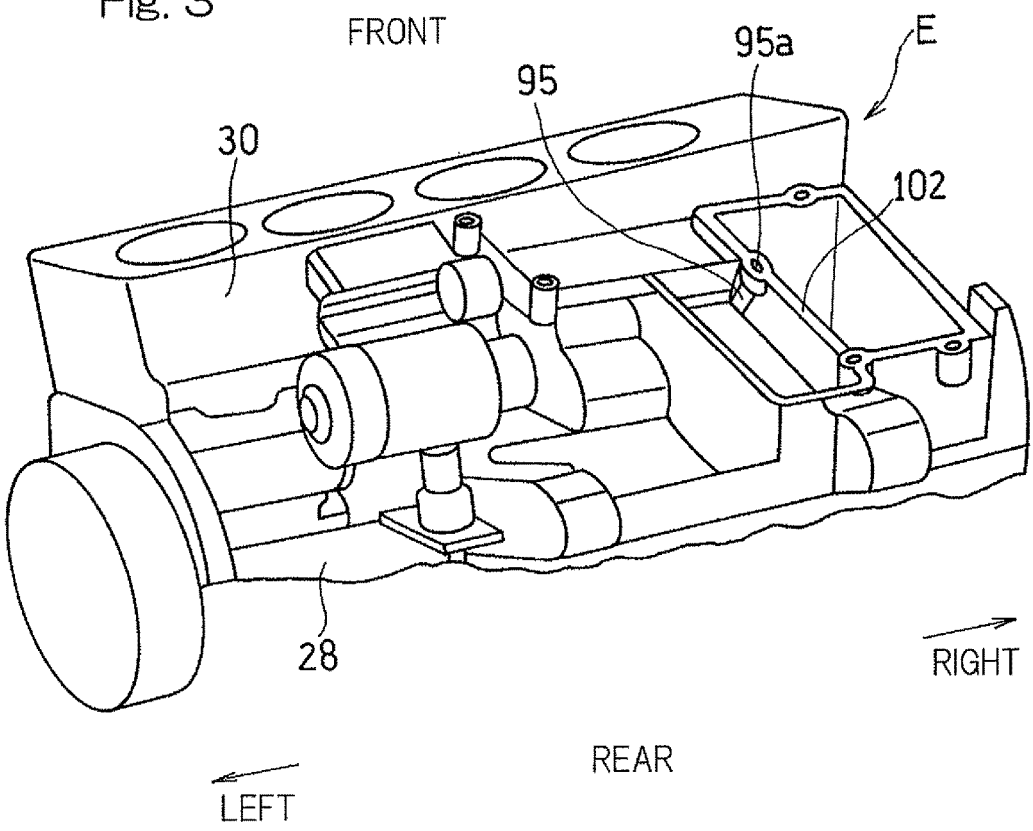
FIG. 3 is a perspective view of the combustion engine in a state where the supercharger is detached, as seen obliquely from the rear and above.

The supercharger lubricating fluid passage 94 is connected to the combustion engine lubricating fluid passage 95 formed in the combustion engine E shown in FIG. 3. That is, an exit port 95*a* of the combustion engine lubricating fluid passage 95 that introduces the lubricating fluid OL from the lubricating fluid pump 29 (FIG. 1) to the supercharger 42 is formed at an abutting surface 102 of the crankcase 28 which abuts the supercharger case 66.

As shown in FIG. 2, the exit port 95*a* of the combustion engine lubricating fluid passage 95 is directly connected to the second passage 100 of the supercharger lubricating fluid passage 94 in the supercharger case 66, and the lubricating fluid OL is supplied from the exit port 95*a* to the bearings 69. When the supercharger case 66 is thus mounted on the combustion engine case EC, the lubricating fluid OL is supplied from the lubricating fluid pump 29 (FIG. 1) to the supercharger lubricating fluid passage 94. The lubricating fluid OL supplied to the supercharger lubricating fluid passage 94 is also supplied to the transmission mechanism 64, the sprocket 62, the chain 74, and the like through an unillustrated passage.

An oil filter 104 for removing foreign matter from the lubricating fluid OL is provided in the supercharger lubricating fluid passage 94. The oil filter 104 is disposed upstream of the portion-to-be-lubricated of the supercharger 42, and filters the oil before being supplied to the portion-to-be-lubricated. In addition, the oil filter 104 is detachably mounted on the supercharger case 66 by an operation from the outside of the supercharger 42. Specifically, the oil filter 104 is attachable to and detachable from the supercharger case 66 in the radial direction. Thus, the oil filter 104 does not interfere with the impeller housing 63 and the transmission mechanism 64 when the oil filter 104 is attached to or detached from the supercharger case 66.

Specifically, the oil filter 104 includes: a filter portion 106 which removes foreign matter from the lubricating fluid OL; a mounting portion 108 which is fixed to the gear case portion 58, i.e., the supercharger case 66; and an operation portion 110 which is exposed to the outside of the supercharger case 66 and with which a tool for attachment/detachment is engaged. An external thread 108*a* to be screwed into the internal thread 98*a* of the supercharger case 66 is formed on the mounting portion 108, and the oil filter 104 is mounted on the radially outer end portion of the first passage 98, which forms the opened end of the first passage 98. That is, the mounting portion 108, which is thread-connected to the supercharger case 66, also serves as a sealing portion that seals the supercharger lubricating fluid passage 94.

Figure 4:
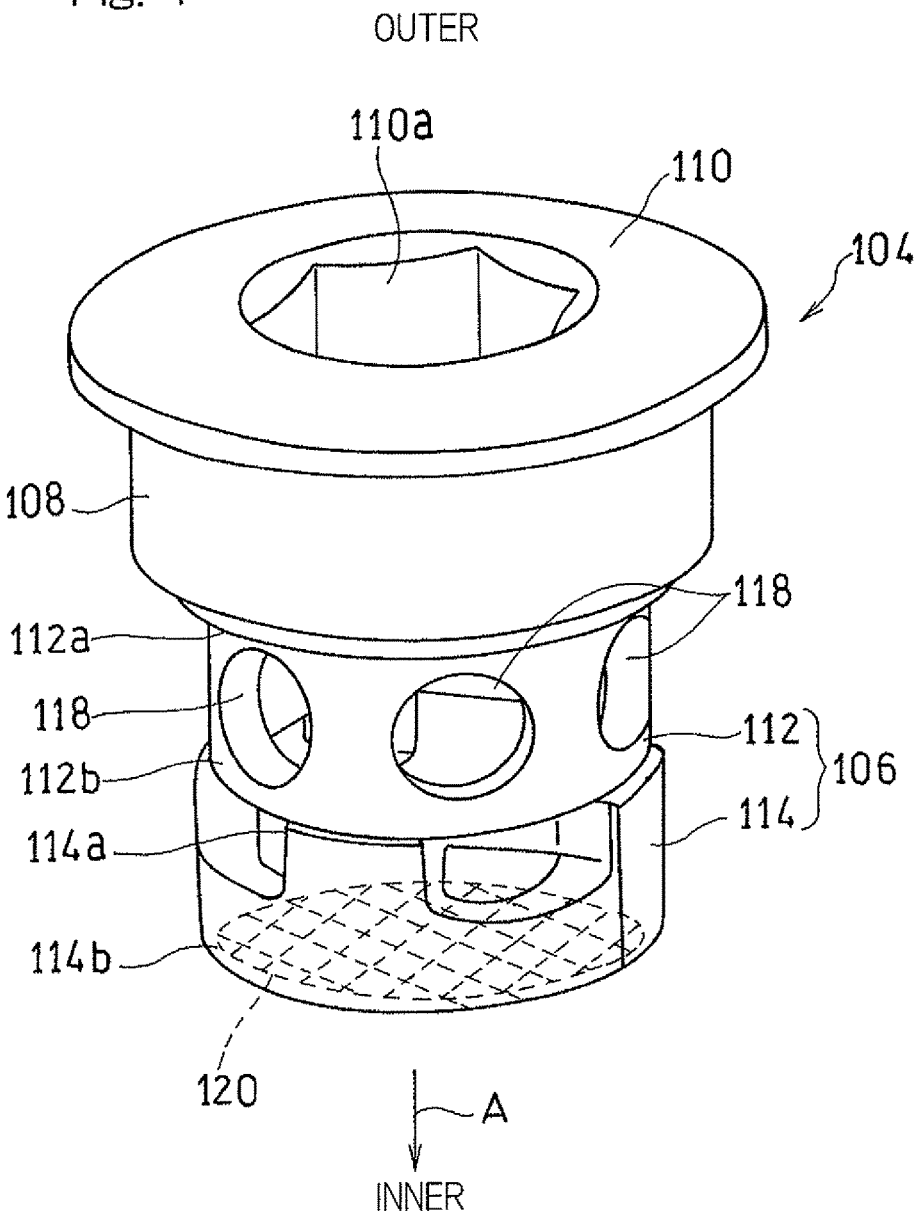
FIG. 4 is a perspective view showing an oil filter of the supercharger.

The first passage 98 extends in a fastening direction which is a radially inward direction of the mounting portion 108. The second passage 100 extends in a direction perpendicular to the fastening direction. The filter portion 106 is disposed at a connecting portion between the first passage 98 and the second passage 100. Specifically, as shown in FIG. 4, the filter portion 106 of the oil filter 104 has an upstream portion 112, which is made of metal and is integrally formed with the mounting portion 108, and a downstream portion 114 that is made of an elastic material such as rubber and is formed separately from the upstream portion 112. The mounting portion 108, the operation portion 110 and the upstream portion 112 are configured to be an indivisible single body, and are mode of steel such as stainless steel. The mounting portion 108, the operation portion 110 and the upstream portion 112 may be separated components. In this case, the upstream portion 112 and the downstream portion 114 may be integrally formed by using an elastic body.

The upstream portion 112 of the filter portion 106 has a tubular shape having an axis in the fastening direction A of the mounting portion 108, and a plurality of through-holes 118 are formed on an outer peripheral wall of the upstream portion 112. An outer opening 112*a* of the upstream portion 112 is closed by being pressure-welded to a bottom wall of the mounting portion 108, and the downstream portion 114 is pressure-welded to an inner opening 112*b* of the upstream portion 112. The downstream portion 114 also has a tubular shape having an axis in the fastening direction A, and an outer opening 114*a* of the downstream portion 114 communicates with the inner opening 112*b* of the upstream portion 112. A mesh 120 is provided in the vicinity of the inner opening 114*b*. Specifically, an outer peripheral portion of the mesh 120 is embedded in the downstream portion 114. As shown in FIG. 5, an inner end surface of the downstream portion 114 is in contact with an annular support step portion 99 formed at an inner surface of the first passage 98, whereby positioning of the filter 104 in the fastening direction A is achieved.

A primary oil filter (not shown) is disposed in the oil pan 34 of the combustion engine E shown in FIG. 1, and a secondary oil filter (not shown) is disposed in the combustion engine lubricating fluid passage 95. Thus, the oil filter 104 shown in FIG. 2 is a tertiary oil filter. The oil filter 104 is coarser than the secondary oil filter. The passage area of the first passage 98 at the downstream side of the oil filter 104 is larger than the passage area of the second passage 100 at the upstream side of the oil filter 104. Thus, the flow velocity of the oil OL is reduced at the upstream side of the oil filter 104, whereby removal of foreign matter is facilitated.

A portion of the supercharger case 66 to which the oil filter 104 is mounted, swells or bulges radially outward relative to the other portion of the supercharger case 66. Thus, the oil filter 104 is disposed radially outward, and attachment and detachment thereof are facilitated. In addition, since the oil filter 104 is provided in the supercharger case 66, the structure of the combustion engine E is simplified as compared to the case where the oil filter 104 is provided on the combustion engine side. For example, when the combustion engine can be used as a non-supercharge combustion engine by removing the supercharger 42, it is preferable that the combustion engine is not provided with an oil filter for a supercharger. Further, when the oil filter 104 is provided in the supercharger case 66, the oil filter 104 can be checked in maintenance of the supercharger 42, whereby workability is improved.

As shown in FIG. 2, a flow rate adjuster 122 constituting a part of the supercharger lubricating fluid passage 94 is provided in the supercharger case 66. Specifically, as shown in FIG. 5, the flow rate adjuster 122 is a cylindrical member, and is disposed in a recess 124 formed at a connecting portion between the input case portion 56 and the gear case portion 58. The recess 124 is formed by enlarging the diameter of a portion of the second passage 100 of the supercharger lubricating fluid passage 94, and forms a storage space concentric with the supercharger lubricating fluid passage 94.

The flow rate adjuster 122 has an inner hollow cavity having a cylindrical shape, and this cavity constitutes a portion of the supercharger lubricating fluid passage 94. An O-ring 125 formed of an elastic body such as rubber is mounted to an outer circumferential surface of the flow rate adjuster 122. The interspace between the flow rate adjuster 122 and the recess 124 is sealed by the O-ring 125, whereby the space between the supercharger lubricating fluid passage 94 and a connecting surface CS between the input case portion 56 and the gear case portion 58 is sealed.

The flow rate adjuster 122 can be attached and detached by loosening the bolt 59 to separate the input case portion 56 and the gear case portion 58. As for the flow rate adjuster 122, one of a plurality of cylindrical members having different inner diameters is selected and mounted, whereby the amount of the lubricating fluid OL flowing through the supercharger lubricating fluid passage 94 is adjusted. For example, by mounting a flow rate adjuster 122A shown by a double dotted line in FIG. 5 instead of the flow rate adjuster 122 shown by a solid line, the passage area of the supercharger lubricating fluid passage 94 is reduced to suppress the flow rate of the lubricating fluid OL.

When the combustion engine E shown in FIG. 1 starts up, the lubricating fluid pump 29 and the supercharger 42 are driven in conjunction with the crankshaft 26. A portion of the lubricating fluid that is pressure-fed from the lubricating fluid pump 29 is introduced from the exit port 95*a* of the combustion engine lubricating fluid passage 95 shown in FIG. 2 into the second passage 100 of the supercharger lubricating fluid passage 94. The flow rate of the lubricating fluid OL introduced into the second passage 100 is adjusted by the flow rate adjuster 122, and thereafter the lubricating fluid OL passes through the oil filter 104.

Specifically, the lubricating fluid OL is introduced from the through-holes 118 of the upstream portion 112 of the filter portion 106 in the oil filter 104 shown in FIG. 5 into the oil filter 104, and the flow direction of the lubricating fluid OL is changed from the left-right direction to the radially inward direction in the upstream portion 112. Further, the lubricating fluid OL passes through the mesh 120 of the downstream portion 114 of the filter portion 106, whereby foreign matter is removed from the lubricating fluid OL. Thereafter, the lubricating fluid OL is introduced to the first passage 98 of the supercharger lubricating fluid passage 94. The lubricating fluid OL introduced to the first passage 98 is supplied to the bearing housing 76 shown in FIG. 2, and lubricates the bearings 69.

When the mesh 120 is cleaned or replaced, a tool such as a torque wrench is engaged in an engagement hole 110*a*, such as a hexagonal hole, of the operation portion 110 of the oil filter 104, and the mounting portion 108 is rotated and loosened. By so doing, the mounting portion 108 integrated with the upstream portion 112, and the downstream portion 114 are removed in order from the supercharger case 66. After the mesh 120 of the removed downstream portion 114 is cleaned, the downstream portion 114 is again inserted to the supercharger lubricating fluid passage 94 or a new downstream portion 114 is inserted to the supercharger lubricating fluid passage 94. Subsequently, the mounting portion 108 is inserted in the supercharger lubricating fluid passage 94, and further, the tool is engaged in the engagement hole 110*a* of the operation portion 110 to fasten the mounting portion 108. By so doing, the oil filter 104 is mounted to the supercharger case 66.

Since the supercharger 42 according to the present embodiment is a centrifugal supercharger, performance thereof is in proportion to the rotation speed, and the rotation speed of the supercharger rotation shaft 44 is set to be high. Therefore, demand for removal of foreign matter from the oil OL to be supplied to the bearings 69 is high. Further, since a portion of the supercharger rotation shaft 44 is supported by the oil layer 96, demand for removal of foreign matter from the oil OL to be supplied to the oil layer 96 is high.

In the above configuration, the oil filter 104 is detachably mounted on the supercharger case 66 by an operation from the outside of the supercharger 42. Therefore, even when the supercharger lubricating fluid passage 94 is formed inside the supercharger case 66, the oil filter 104 can be easily replaced or cleaned.

The supercharger lubricating fluid passage 94 is connected to the combustion engine lubricating fluid passage 95, and foreign matter such as metal abrasion powder may be contained in the lubricating fluid OL in the combustion engine lubricating fluid passage 95. However, since the oil filter is provided in the supercharger lubricating fluid passage 94, such foreign matter can be removed by the oil filter 104. Accordingly, the oil for the combustion engine E can be suitably used for lubrication of the supercharger 42.

The oil filter 104 includes the filter portion 106 for removing foreign matter, the mounting portion 108 to be screwed into the supercharger case 66 and the operation portion 110 exposed to the outside of the supercharger case 66. Therefore, the oil filter 104 can be easily replaced by operating the operation portion 110 from the outside of the supercharger 42 with the use of a tool. In addition, since the mounting portion 108 also serves as a sealing portion to seal the supercharger lubricating fluid passage 94, the number of components can be reduced.

The filter portion 106 of the oil filter 104 is disposed at the connecting portion between the first passage 98 and the second passage 100. Therefore, the oil filter 104 can be formed by using a plug hole in machining.

The oil filter 104 is mounted to the first passage 98 radially extending from the bearing housing 76. Therefore, the oil filter 104 can be disposed in the vicinity of the bearings 69, which are portions-to-be-lubricated, mixing of foreign matter into the bearings 69 can be effectively avoided.

The flow rate adjuster 122, which constitutes a portion of the supercharger lubricating fluid passage 94, is provided in the supercharger case 66. When the lubricating fluid is supplied from the combustion engine lubricating fluid passage 95, the amount of the supplied lubricating fluid may be larger than the amount of the lubricating fluid required for the supercharger 42. However, by selecting the flow rate adjuster 122, the flow rate of the lubricating fluid OL can be adjusted. In addition, since the flow rate adjuster 122 can be attached and detached by loosening the bolt 59 (FIG. 5) and separating the input case portion 56 and the gear case portion 58, it is easy to replace the flow rate adjuster 122.

The internal gear 82 of the planetary gear device 64 and the input gear 92 of the input shaft 65 are connected to each other through the positioning member 93, with movement of the input shaft 65 being restricted in the axial direction. Thereby, movement of the input shaft 65 in the axial direction is restricted, and the relative position between the internal gear 82 and the input gear 92 in the axial direction can be appropriately restricted. In addition, since the positioning member 93 is formed by bending a wire in an annular shape, the structure thereof is simple.

The present invention is not limited to the embodiments described above, and various additions, modifications, or deletions may be made without departing from the gist of the invention. Although in the embodiment described above, the supercharger of the present invention is applied to a combustion engine for a motorcycle, the supercharger is also applicable to combustion engines for vehicles other than motorcycles, water crafts and the like, and furthermore, to combustion engines installed on the ground. Further, as the power transmission member, a tooth belt may be used instead of the chain 74.

The filter portion 106 and the mounting portion 108 may be integrally configured. Although the first passage 98 and the second passage 100 are perpendicular to each other in the above preferred embodiment, the both passages 98 and 100 may intersect each other, and may not be necessarily perpendicular to each other. Further, no bearing may be formed in the supercharger case 66. Therefore, these are construed as included within the scope of the present invention.

REFERENCE NUMERALS

95 . . . combustion engine lubricating fluid passage
42 . . . supercharger
44 . . . supercharger rotation shaft
56 . . . input case portion (case half)
58 . . . gear case portion (case half)
60 . . . impeller
64 . . . transmission mechanism (planetary gear device)
65 . . . input shaft
66 . . . supercharger case
80 . . . planetary gear
82 . . . internal gear
92 . . . input gear
93 . . . positioning member
94 . . . supercharger lubricating fluid passage
98 . . . first passage (supercharger lubricating fluid passage)
98*a* . . . internal thread
100 . . . second passage (supercharger lubricating fluid passage)
104 . . . oil filter (filter)
106 . . . filter portion
108 . . . mounting portion
108*a* . . . external thread
110 . . . operation portion
122 . . . flow rate adjuster
E . . . combustion engine

What is claimed is:

1. An engine unit comprising:
a combustion engine having a combustion engine case;
a combustion engine lubricating fluid passage formed entirely within the combustion engine case and having an exit port; and
a supercharger that is detachably mounted to the combustion engine and supplies intake air to the combustion engine, the supercharger comprising:
an impeller configured to pressurize intake air for the combustion engine;
an impeller housing configured to cover the impeller;
a supercharger rotation shaft to which the impeller is fixed;
a supercharger case configured to support the supercharger rotation shaft;
a supercharger lubricating fluid passage formed entirely within the supercharger case, having an opening abutting the exit port of the combustion engine lubricating fluid passage, directly connecting the supercharger lubricating fluid passage to the combustion engine lubricating fluid passage, and configured to guide a lubricating fluid for the combustion engine to a portion-to-be-lubricated of the supercharger, the lubricating fluid being operable to lubricate portions-to-be-lubricated in the engine; and
a filter disposed in the supercharger lubricating fluid passage, and configured to remove foreign matter from the lubricating fluid, the filter being detachably mounted on the supercharger case and including:
a filter portion that removes the foreign matter from the lubricating fluid;
a mounting portion having an external thread to be screwed into an internal thread formed in the supercharger case; and
an operation portion exposed to the outside of the supercharger case, with which a tool for attachment/detachment can be engaged.

2. The engine unit as claimed in claim 1, wherein the mounting portion also serves as a sealing portion that seals the supercharger lubricating fluid passage.

3. The engine unit as claimed in claim 1, further comprising:
a planetary gear device configured to change a speed of power, and output the power to the supercharger rotation shaft, the planetary gear device including a planetary gear and an internal gear engaged with the planetary gear;
an input shaft configured to input the power to the planetary gear device, the input shaft having an input gear connected with the internal gear; and
a positioner, wherein
the internal gear is connected with the input gear, with movement of the input shaft in an axial direction being restricted by the positioner.

4. The engine unit as claimed in claim 1, further comprising:
two case halves forming the supercharger case, the two case halves being connected to each other by means of a bolt, wherein
a portion of the supercharger lubricating fluid passage extends over the two case halves.

5. The engine unit as claimed in claim 1, further comprising:
the supercharger lubricating fluid passage includes a first passage arranged at a downstream side of the filter and a second passage arranged at an upstream side of the filter; and
a passage area of the first passage is larger than a passage area of the second passage.

6. The engine unit as claimed in claim 1, further comprising:
a portion of the supercharger case, to which the filter is mounted, bulges radially outward relative to a remaining portion of the supercharger case.

7. The engine unit as claimed in claim 1, wherein:
the operation portion of the filter is provided with an engagement hole in which a tool can be engaged.

8. The engine unit as claimed in claim 1, wherein
the supercharger lubricating fluid passage includes a first passage that extends in parallel to a fastening direction of the mounting portion, and a second passage that extends in a direction intersecting the fastening direction and is connected to the first passage, and
the filter portion is disposed at a connecting portion between the first passage and the second passage.

9. The engine unit as claimed in claim 8, wherein the first passage extends in a radial direction from a bearing portion of the supercharger rotation shaft in the supercharger case, and has a radially outer end portion being opened, and the filter is mounted to the opened end portion of the first passage.

10. An engine unit comprising:

a combustion engine; and a supercharger that is mounted to the combustion engine and supplies intake air to the combustion engine, the supercharger comprising:

an impeller configured to pressurize intake air for the combustion engine;

an impeller housing configured to cover the impeller;

a supercharger rotation shaft to which the impeller is fixed;

a supercharger case configured to support the supercharger rotation shaft;

a supercharger lubricating fluid passage formed inside the supercharger case, and configured to guide a lubricating fluid for the combustion engine to a portion-to-be-lubricated of the supercharger, the lubricating fluid being operable to lubricate portions-to-be-lubricated in the engine; and a filter disposed in the supercharger lubricating fluid passage, and configured to remove foreign matter from the lubricating fluid, the filter being detachably mounted on the supercharger case, wherein the filter includes:

a filter portion that removes the foreign matter from the lubricating fluid;

a mounting portion having an external thread to be screwed into an internal thread formed in the supercharger case; and an operation portion exposed to the outside of the supercharger case, with which a tool for attachment/detachment can be engaged, the filter portion includes: an upstream portion, which is integrally formed with the mounting portion; and a downstream portion which is made of a rubber material and is formed separately from the upstream portion, and the mounting portion, the operation portion and the upstream portion are configured to be an indivisible single body.

11. An engine unit comprising:

a combustion engine having a combustion engine case;

a combustion engine lubricating fluid passage formed entirely within the combustion engine case and having an exit port; and a supercharger that is detachably mounted to the combustion engine and supplies intake air to the combustion engine, the supercharger comprising:

an impeller configured to pressurize intake air for the combustion engine;

an impeller housing configured to cover the impeller;

a supercharger rotation shaft to which the impeller is fixed;

a supercharger case configured to support the supercharger rotation shaft;

a supercharger lubricating fluid passage formed entirely within the supercharger case, having an opening abutting the exit port of the combustion engine lubricating fluid passage, directly connecting the supercharger lubricating fluid passage to the combustion engine lubricating fluid passage, and configured to guide a lubricating fluid for the combustion engine to a portion-to-be-lubricated of the supercharger, the lubricating fluid being operable to lubricate portions-to-be-lubricated in the engine; and a filter disposed in the supercharger lubricating fluid passage, and configured to remove foreign matter from the lubricating fluid, the filter being detachably mounted on the supercharger case, further comprising:

two case halves forming the supercharger case, the two case halves being connected to each other by means of a bolt, a part of the supercharger lubricating fluid passage extending in an axial direction of the bolt across the two case halves, and a flow rate adjuster that constitutes a part of the supercharger lubricating fluid passage and is provided in the supercharger case, the flow rate adjuster being attached to and detached from the supercharger case by separating the two case halves from each other by loosening the bolt.

12. The engine unit as claimed in claim 11, wherein a portion of the supercharger lubricating fluid passage, which portion is formed within the flow rate adjuster, extends in an axial direction of the supercharger rotation shaft, and another portion of the supercharger lubricating fluid passage, which portion is formed downstream of the filter, extends in a radial direction of the supercharger rotation shaft.

13. The engine unit as claimed in claim 11, wherein the flow rate adjuster includes:

an inner hollow cavity having a cylindrical shape, the cavity constituting a portion of the supercharger lubricating fluid passage;

a plurality of annular grooves formed on an outer circumferential surface thereof, the annular grooves being arranged in an axial direction of the flow rate adjuster; and a sealing member mounted to each of the annular grooves, thereby to seal a space between the supercharger lubricating fluid passage and a connecting surface of the two case halves.

* * * * *